United States Patent [19]

Leblanc et al.

[11] 4,167,926

[45] Sep. 18, 1979

[54] INJECTION PUMP

[75] Inventors: Jean Leblanc; Jean Borrel, both of Lyons, France

[73] Assignee: Sigma Diesel, Venissieux, France

[21] Appl. No.: 758,122

[22] Filed: Jan. 10, 1977

[30] Foreign Application Priority Data

Jan. 12, 1976 [FR] France ..... 76 00645

[51] Int. Cl.[2] ..... F02M 39/00

[52] U.S. Cl. ..... 123/139 R

[58] Field of Search ..... 123/139 R, 139 AA, 139 AP; 73/119 A; 116/115, 124 A, 124 D, DIG. 6, DIG. 39; 417/63, 399, 485, 486

[56] References Cited

U.S. PATENT DOCUMENTS

| | | | |
|---|---|---|---|
| 2,611,837 | 9/1952 | Zirin | 116/24 D |
| 2,691,888 | 10/1954 | Daulby | 73/118 |
| 3,091,231 | 5/1963 | Giraudon | 123/139 R |
| 3,327,526 | 6/1967 | North | 73/118 |

FOREIGN PATENT DOCUMENTS

| | | | |
|---|---|---|---|
| 585,011 | 9/1933 | Fed. Rep. of Germany | 123/139 R |
| 1045169 | 11/1953 | Fed. Rep. of Germany | 123/139 R |
| 872752 | 7/1961 | United Kingdom | 417/63 |

OTHER PUBLICATIONS

"Review of Technique Automobile", 1961, No. 183, "Vehicules Utilitaires", pp. 75, 77.

Orline, A.C.; "International Combustion Engines", p. 210, FIG. 143.

Malov, A. N.; "Memo-Book for Metal Workers"; Machinostroenic; Moscow, 1965; p. 762.

*Primary Examiner*—Charles T. Jordan

*Attorney, Agent, or Firm*—Peter K. Kontler

[57] ABSTRACT

A fuel injection pump for an internal combustion engine is provided with a graduated sector on a part which rotates with the cam shaft of the pump and which is disposed within the pump casing. The casing is provided with a viewing aperture through which the graduated sector can be seen. Indicating means are provided in the viewing aperture so as to co-operate with the graduated sector to indicate the angular position of the pump shaft, thereby facilitating setting of the timing of the pump shaft rotation relative to the rotation of the engine crank shaft.

14 Claims, 6 Drawing Figures

INJECTION PUMP

BACKGROUND OF THE INVENTION

The invention relates to an injection pump having means for setting the timing of the rotation of a shaft of the pump, for example in relation to the rotation of a crank shaft of an engine supplied with fuel by the pump.

The timing of a pump in relation to an engine consists of course of placing the pump cam shaft in such a predetermined angular position relatively to the engine crankshaft that fuel injection starts at a predetermined time relative to engine piston travel, more particularly relative to the top dead centre position.

The start of dynamic injection during operation of the pump differs from the theoretical static injection start.

It is an object of the invention to improve the practical performance of an injection pump having means for timing its shaft, with particular emphasis on improving the accuracy of timing.

SUMMARY OF THE INVENTION

An injection pump according to the invention comprises a graduated sector provided on a part rotatable rigidly with the pump shaft, such part being disposed inside the pump casing. The pump casing has a wall formed with a viewing aperture aligned with the path of movement followed by the graduated sector on rotation of the pump shaft. A removable plug is received in the viewing aperture and indicating means are carried by the pump casing for co-operating with the graduated sector to indicate the angular position of the pump shaft.

Preferably, the graduated sector is disposed on a cylindrical wall of revolution disposed adjacent that zone of the casing wall which is formed with the viewing aperture.

In the case of a distributor type injection pump comprising an annular cam which rotates solidly with the pump shaft and whose inner wall has cam lobes for driving the pump pistons, the cylindrical wall of revolution takes the form of a cylindrical wall of the pump shaft which serves to centre the annular cam.

In a variant, the graduated sector may be disposed on the outside cylindrical surface of the annular cam.

In the case of a linear injection pump, the cylindrical wall which has the graduations can take the form of a zone of the centrifugal governor.

The graduated sector may extend right round the circumference—i.e. over 360°.

Advantageously, the graduated sector extends over a zone of approximately 30°.

Preferably, the indicating means take the form of a pointer disposed in a recess in the viewing aperture of the pump casing wall, the pointer being placed below the plug.

The pointer may be constructed inter alia from cut and shaped metal strip. The pointer may comprise a split ring which is compressed in the recess whereby the ring is retained in the recess by the natural resilience of the ring.

The split ring may have two radially inwardly projecting protuberances on its periphery to facilitate positioning in the recess.

The split ring carries an inwardly extending needle which advantageously extends from the ring to the centre of the viewing aperture recess.

For measuring and adjusting operations, a plug made of a transparent substance, which may serve as a magnifying lens, can be fitted into the viewing aperture.

The invention also relates to a method of timing a pump according to the invention, wherein a pressure sensor is fitted to a pump delivery connection associated with the graduated sector, the sensor is so connected to a strobe lamp actuator that each pressure increase at the delivery connection produces a flash of the strobe lamp, and the graduated sector of the injection pump is observed during rotation of the pump shaft with the aid of the strobe lamp so as to discover the graduation opposite the mark when the flash occurs, such graduation determining the angular position of the pump shaft at the start of dynamic injection for the cylinder associated with the delivery connection to which the pressure sensor is connected. Advantageously, the pump casing outer wall has, near the means for viewing the graduated sector, a plate or area or the like and an indication is provided thereon or directly on the casing outer wall of the value to which the graduated sector should be set for correct timing of the pump.

Further features and advantages of the invention will appear from the following description of a preferred embodiment of the invention, given with reference to the appended drawings.

DESCRIPTION OF PREFERRED EMBODIMENT

Figure 1:
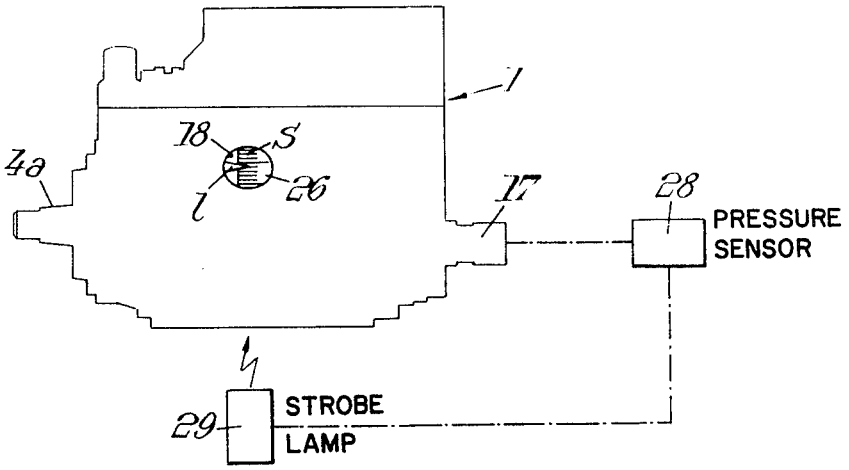
FIG. 1 is a diagrammatic overall view showing an injection pump according to the invention prepared for timing adjustment.

Referring to the drawings, there can be seen a distributor type fuel injection pump 1 which is basically of known construction and which therefore need not be described in detail here. A few reminders on how such a pump is devised will however be given.

Figure 6:
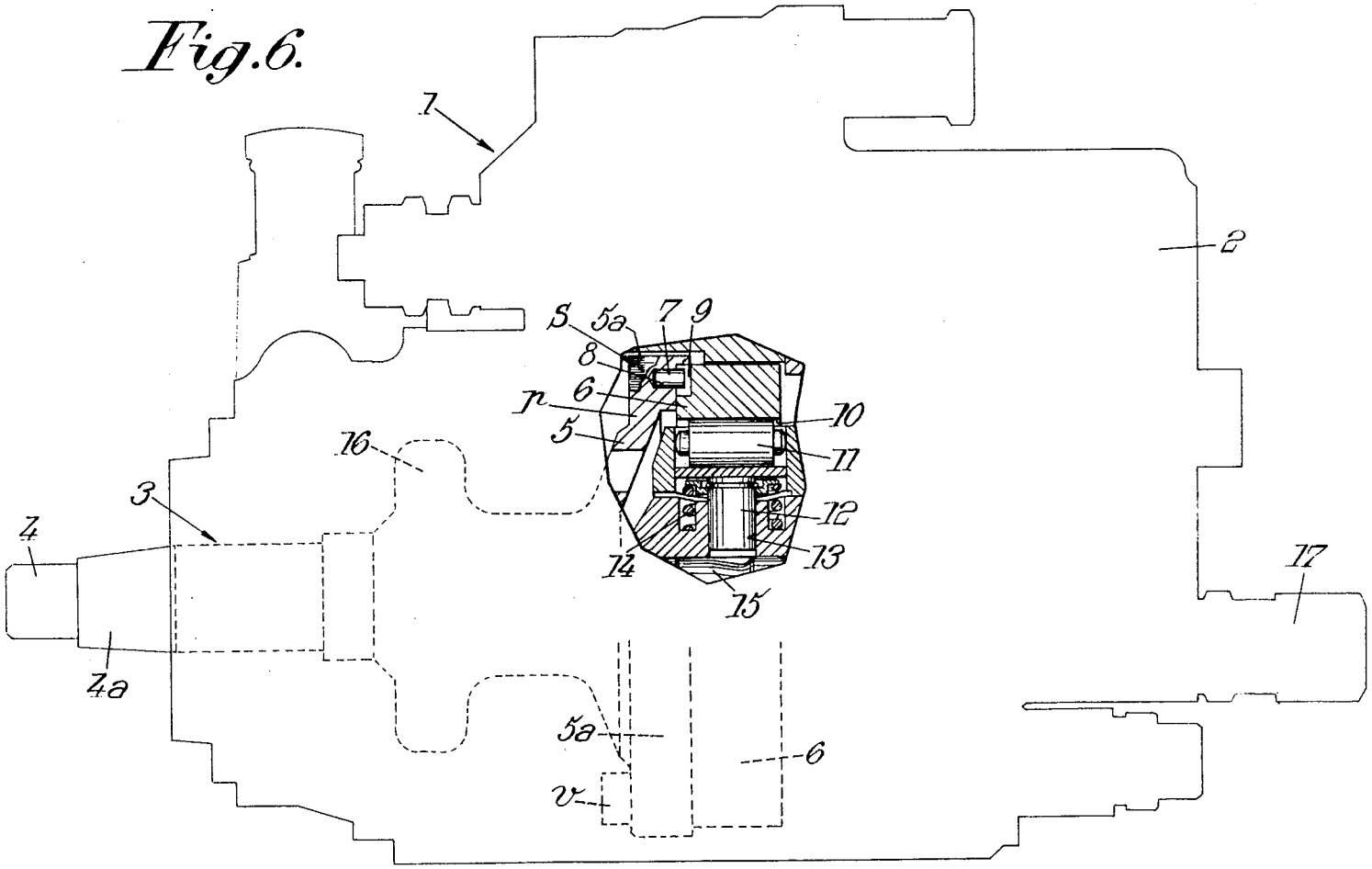
FIG. 6 is a diagrammatic view, with parts broken away, of a distributor type injection pump according to the invention.

The pump has a casing 2 into which a cam shaft 3 extends. Outside the casing 2 the cam shaft 3 has a part 4 formed with a frusto-conical region **4*a* adapted to be connected to a driving sleeve. Inside the casing 2 shaft 3 has a frusto-conical enlargement 5 which can be seen in FIG. 6. An annular cam 6 is secured to the circular peripheral edge p of the enlargement 5. Edge p has a cylindrical wall for centering the cam 6, such wall having an outside surface 5*a***.

The angular position of cam 6 relative to enlargement 5 and therefore relative to shaft 3 can be accurately determined by co-operation between a pin 7 received in a blind bore 8 in edge p and a groove 9 in that surface of the cam 6 which is adjacent the enlargement 5. Connecting means, such as screws v, are also provided to secure cam 6 to member 5 and to transmit the torque thereof to cam 6.

Cam 6 has a central recess bounded by a surface 10 having a number of cam lobes depending upon the number of cylinders of the internal combustion engine to be supplied with fuel by the injection pump. The surface 10 of cam 6 cooperates with thrust rollers 11 each associated with a piston 12 of the injection pump and producing reciprocating sliding movements of the piston 12 in a respective cylinder 13. A return spring 14 maintains roller 11 in engagement with surface 10 of cam 6. Clearly, therefore, the cam 6 as it rotates reciprocates the pistons 12 as a result of co-operation between the lobes of surface 10 and the rollers 11.

The pistons 12 deliver a liquid fuel at high pressure, the fuel then going to injectors.

A distributing rotor 15 driven by shaft 5 and shiftable relative thereto provides, at appropriate times and by way of grooves, communication between the cylinders 13 and the fuel intake from a fuel feed pump (not shown) and communication between cylinders 13 and the respective various delivery connections when the pistons 12 deliver fuel at high pressure.

A centrifugal governor 16 rotated by shaft 4 controls the displacements of the distributing rotor 15.

As can be seen in FIG. 1, each delivery connection 17 is adapted to be connected to the corresponding cylinder of the internal combustion engine.

When such an injection pump is fitted to an internal combustion engine, the pump cam shaft 3 must be given a particular angular setting or timed relatively to the engine crankshaft. This setting or timing operation consists of placing the pump cam shaft 3 in a predetermined angular position relative to the engine crank shaft.

Statically, the start of injection occurs when the grooves of the rotating distributor 15 cut off communication between the cylinders and the pump casing and connect the cylinders to one of the delivery connections. This static start therefore corresponds to a particular geometric position of the various parts of the pump and to a particular angular position of its cam shaft 3.

However, when the pump is in operation and supplying an internal combustion engine, the main factor governing correct pump timing is the beginning of dynamic injection, which corresponds to the time at which the pressure of the pressurized fuel delivered by the piston 12 becomes high enough for the fuel to be introduced into the corresponding engine cylinder. A particular angular position of the pump cam shaft 3 corresponds to this dynamic injection start. The angular positions of shaft 3 for static injection and dynamic injection starts are different from one another.

The invention provides means for timing the injection pump accurately, having regard more particularly to the dynamic injection start.

Accordingly, the pump comprises a graduated sector S disposed on a part of the pump shaft; advantageously, the latter part is a zone of the cylindrical outside surface of revolution 5*a* of the cam-centering wall. The surface 5*a* is disposed adjacent the inside wall 2*a* of the casing 2.

Figure 2:
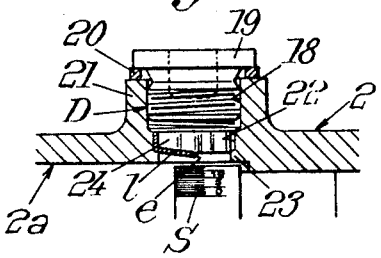
FIG. 2 is a partial section, on the line II—II of FIG. 3, of the casing wall.

Means D are provided so that the sector S may be observed when the pump 1 has been fitted to the engine. The means D are in the form of an aperture 18, namely a tapped hole in a zone of the casing wall (FIG. 2) opposite the path along which the graduated sector S moves as the pump rotates. In practice, the axis of the aperture 18 is in a plane perpendicular to the axis of the shaft 3 and substantially equidistant from the longitudinal ends of the graduations of the graduated sector.

Aperture 18 is adapted to receive a releasable screw-threaded plug 19. A gasket 20 is provided between a head of plug 19 and the end face of a protuberance 21 of casing 2, protuberance 21 being formed with aperture 18.

The aperture 18 includes a plain section 22 and is bounded in the part near the inside of the casing by a circular shoulder 23 which projects radially and inwardly. The section 22 bounds a recess adapted to receive indicating means R for reading the position of the graduated sector S.

Figure 5:
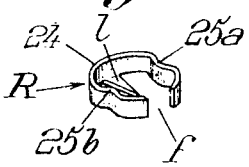
FIG. 5 is a perspective view of a pointer serving as indicating means.

Advantageously, the indicating means R takes the form of a timing pointer 24 constructed from a strip or sheet of metal which is cut out and shaped. The pointer 24 is in the form of a split ring as can be seen clearly in FIGS. 3 and 5, having a gap f.

The outside diameter of pointer 24 in the unassembled condition is greater than the diameter of recess 22. The pointer 24 is therefore compressed when received in recess 22 and is retained in the recess by its natural resilience, no other member being necessary to secure it. The recess 22 is cylindrical and grooveless and so is simple and cheap to devise.

The pointer 24 is formed with two radially inwardly projecting protuberances 25*a*, 25*b* which are disposed substantially diammetrically opposite one another. These protuberances facilitate positioning of the pointer 24 since they make it possible either to use pliers or to provide a bearing surface for a press-fitting operation using a cylindrical mandrel whose diameter is less than the diameter of recess 22 but sufficient to bear on a part of the protuberances 25*a*, 25*b*.

A reading needle 1 disposed near the path followed by the graduated sector S is an integral part of the pointer 24 and is disposed in a plane substantially perpendicular to the geometric axis of the split ring but with an inclination towards the inside of the casing 2 (see FIG. 2) so that the needle end e is nearer the path followed by the sector S. Advantageously, the length of the needle 1 is such that its end e coincides with the centre of recess 22; mis-orientation in the assembly of the pointer 24 does not therefore lead to misreadings.

The pointer 24 is therefore disposed between the base of plug 19 and the outside wall 5*a* which rotates with shaft 4 and on which the graduated sector S is marked.

Figure 4:
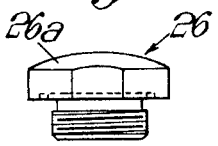
FIG. 4 is a side view of a combined transparent plug and lens.

The plug 19 is metal and opaque. For measuring and adjusting operations when it is required to observe the graduated sector S, however, the plug 19 is replaced by a transparent plug 26 which is shown in FIG. 4 and which is made for example of plastics and which can be screwed into the hole 18. Plug 26 can be devised like a lens or magnifying glass so that the sector S may be viewed on an enlarged scale, in which event the top surface 26*a* of the plug takes the form of a convex part-spherical member.

Alternatively, the transparent plug 26 can remain in the pump 1 permanently.

The graduated sector S extends over all or some of the periphery of wall 5*a*, preferably over a zone of approximately 30°. The sector S is so disposed as to have a zone opposite the pointer 24 at the start of injection for a predetermined delivery connection 17 of the injection pump. Although the angular position of this injection start is not known accurately beforehand, the size of the graduated sector is sufficient for its previous positioning to make it possible, in the measurements to be described hereinafter, to observe a zone of the sector at the start of injection.

Figure 3:
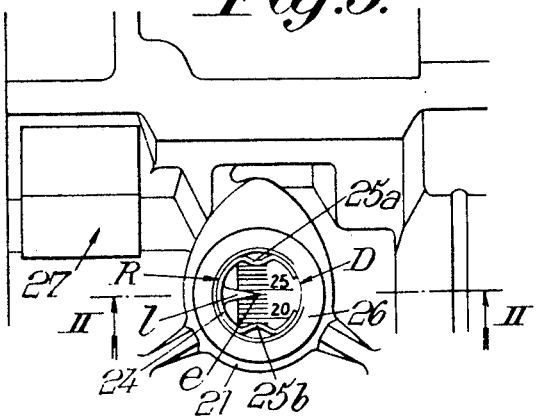
FIG. 3 is a plan view corresponding to FIG. 2, a transparent plug being disposed in the viewing aperture.

A plate or panel 27 visible in FIG. 3 is provided on the outside wall of casing 2 near the protuberance 21 which is formed with the aperture 18. The plate 27 is marked with that number on the graduated sector which must be placed opposite the needle end e to ensure that the pump cam shaft 3 is in the angular position corresponding to correct timing or setting of the pump.

In the case of a linear pump—i.e., a pump comprising a number of cylinders whose axes are parallel to one another and which are coplanar with one another—features similar to those hereinbefore described for a distributor type injection pump can be provided. In a linear pump a graduated sector can be placed on the outside surface of a cylindrical part which rotates rigidly with the pump cam shaft and which is associated with the centrifugal governor. The wall of the pump casing has a zone disposed near the path of the graduated sector, such zone being formed with a viewing aperture similar to the aperture 18.

For measuring and adjustment operations, that delivery connection 17 (FIG. 1) of the injection pump which is associated with the graduated sector S is connected to a pressure sensor 28 which is connected to a strobe lamp device 29, the arrangement being such that the pressure increase which occurs at the connection 17 and corresponds to the start of dynamic injection is detected by the sensor 28 which causes the lamp 29 to flash. The flash frequency is equal to the frequency of pressure increases at the connection 17 and such frequency is either equal to or an integral multiple of the frequency at which the sector S passes by the hole 18.

The sector S when viewed through the transparent plug 26 in the aperture 18 in the light of the flashes from the lamp 29 appears stationary to the observer who can read the graduation below the needle end e.

Accordingly, the measuring and adjusting operations required to time an injection pump are performed as follows in accordance with the invention:

The pump 1 with the transparent plug 26 in position in the hole 28 is fitted to an electric test bench (not shown) on which the pump cam shaft 3 can be rotated by an electric motor. The pressure sensor 28 is connected to the delivery connection 17; the casing 2 is filled with liquid fuel and the pump cam shaft 3 is rotated to deliver fuel via the connection 17. It has been found in experiments that the presence of fuel in the casing 2 does not hinder the reading of the graduated sector S which is immersed in the fuel. Shaft 3 is rotated at a given speed and the lamp 29 produces a flash for each pressure increase at the connection 17, corresponding to the beginning of dynamic injection at the connection 17. The plug 26 and sector S are viewed in the light emitted by the lamp 29, because of the stroboscopic effect of the sector S when viewed through the aperture 18 appears stationary. The graduation, which is the graduation 24 in the example shown in FIG. 3, opposite the needle end e is then noted. This indicates that the angular position of the shaft 3 at which the observed graduation of the sector S appears opposite the needle end e corresponds to the start of dynamic injection at the connection fitted with the sensor.

The plate 27 or the actual casing is then marked either with the value found in the test just described or with a value equal to the algebraic sum of the value found plus a constant determined in accordance with specific conditions for fitting and timing the pump on the internal combustion engine.

For instance, if the pump must be so timed that dynamic injection is to start in advance of the top dead-centre position of the piston in the corresponding cylinder of the engine, the observed value is modified in dependence upon the required advance and the plate 27 is marked with the value calculated in this way from the observed value.

Subsequently, when the pump is fitted to the engine it is timed relative to the engine crankshaft in the following way:

The engine crankshaft is placed in a predetermined position, e.g. the position corresponding to the top dead-centre position of the piston of the engine cylinder associated with the pump delivery connection corresponding to the graduated sector S. The pump camshaft 3 is placed in the angular position in which the number marked on the plate 7 appears opposite the needle end e and the injection pump shaft is connected to the engine. Accurate timing is therefore provided of the true start of hydraulic and dynamic injection of the pump. After the pump has been fitted to the engine the transparent plug 26 can be replaced by the opaque metal plug 19.

The invention therefore makes it readily possible to provide the initial timing of the pump when fitted to the engine since all that has to be done is to turn the pump camshaft 3 until the timing graduation of the sector S comes opposite the needle end e.

It is also a simple matter to check engine timing in operation. The pump can also be checked for the value of changes in advance produced by the automatic advance system in association with the pump corrector in dependence upon pump speed. To this end, the transparent plug 26 is first placed in the aperture 18 and the strobe lamp 29 in association with the pressure sensor 28 is used to observe the various scale markings appearing opposite the needle end e at various speeds of the pump camshaft 3.

The timing pointer 24 is very simple to devise; also, placing it near the path of the graduated sector S and more particularly inclining the needle 1 towards such path reduces parallax errors in reading the sector S.

We claim:

1. An injection pump for an internal combustion engine, said pump comprising:

a pump casing;

a rotatable pump shaft extending into said pump casing; and means for setting the timing of the pump shaft rotation;

said timing means comprising:

a part rotatable rigidly with said pump shaft, said part having a surface provided with a graduated sector, said part being disposed inside said pump casing;

said pump casing having a wall formed with a viewing aperture aligned with the path of movement followed by said graduated sector on rotation of said pump shaft, said viewing aperture being a tapped hole adapted to receive, for normal operation, a releasable metal screw-threaded plug, and for measuring or adjusting the timing, a transparent plug; and indicating means carried by said pump casing for cooperating with said graduated sector to indicate the angular position of said pump shaft.

2. An injection pump as claimed in claim 1, wherein said part rotatable rigidly with said pump shaft has a cylindrical wall of revolution provided with said graduated sector.

3. An injection pump as claimed in claim 2, comprising:

an enlarged portion of said pump shaft inside said pump casing, said enlarged portion having said cylindrical wall;

an annular cam rotatable rigidly with said pump shaft and centred by an outer surface of said cylindrical wall of said enlarged pump shaft portion, said cam having an inner face formed with cam lobes; and pump pistons disposed within said annular cam for actuation by said cam lobes on rotation of said pump shaft;

said graduated sector being provided on said outer surface of said cylindrical wall of said enlarged pump shaft portion.

4. An injection pump as claimed in claim 1, further comprising:

an annular cam rotatable rigidly with said pump shaft and disposed inside said pump casing, said cam having an outer cylindrical face and an inner face formed with cam lobes; and pump pistons disposed within said annular cam for actuation by said cam lobes on rotation of said pump shaft;

said graduated sector being provided on said outer cylindrical face of said cam.

5. An injection pump as claimed in claim 1, wherein said graduated sector extends for an angle of 360°.

6. An injection pump as claimed in claim 1, comprising a plate on the outside of said pump casing, said plate carrying an indication of the value to which said graduated sector should be set relative to said indicating means for correct timing of the pump shaft rotation.

7. An injection pump as claimed in claim 1 comprising a transparent removable plug disposed in said viewing aperture.

8. An injection pump as claimed in claim 7 wherein said transparent plug has a convex part-spherical portion providing optical magnification when viewing said graduated sector through said viewing aperture.

9. An injection pump for an internal combustion engine, said pump comprising:

a pump casing;

a rotatable pump shaft extending into said pump casing; and means for setting the timing of the pump shaft rotation in which injection pump said timing means comprises:

a part rotatable rigidly with said pump shaft, said part having a surface provided with a graduated sector, said part being disposed inside said pump casing;

said pump casing having a wall formed with a viewing aperture aligned with the path of movement followed by said graduated sector on rotation of said pump shaft;

a removable plug received in said viewing aperture; and indicating means carried by said pump casing for co-operating with said graduated sector to indicate the angular position of said pump shaft, said indicating means comprising pointer means received in said viewing aperture, said pump casing defining in said viewing aperture a recess below said removable plug, said pointer means being located in said recess.

10. An injection pump as claimed in claim 9, wherein said pointer means comprises a resiliently deformable split ring which is compressed in said recess in said viewing aperture whereby said ring is retained in said recess by the natural resilience of said ring.

11. An injection pump as claimed in claim 10, wherein said split ring of said pointer means is formed with two radially inwardly projecting protuberances.

12. An injection pump as claimed in claim 10, wherein said split ring carries an inwardly extending needle extending from said ring to the center of said recess in said viewing aperture.

13. An injection pump as claimed in claim 12, wherein said needle is inclined towards said graduated sector so that its free end at the center of said recess is nearer said graduated sector than its end connected to said split ring.

14. A method of timing an injection pump, said pump comprising:

a pump casing;

a rotatable pump shaft extending into said pump casing;

a part rotatable rigidly with said pump shaft, said part having a surface provided with a graduated sector, said part being disposed inside said pump casing;

said pump casing having a wall formed with a viewing aperture aligned with the path of movement followed by said graduated sector on rotation of said pump shaft;

indicating means carried by said pump casing for co-operating with said graduated sector to indicate the angular position of said pump shaft; and a pump delivery connection corresponding to said graduated sector;

which method comprises:

fitting a pressure sensor to said delivery connection; connecting said pressure sensor to a strobe lamp actuator so that each pressure increase at said delivery connection produces a flash of light from said strobe lamp; and observing said graduated sector through said viewing aperture in the light of said strobe lamp to determine the graduation of said graduated sector indicated by said indicating means when the flash of said strobe lamp occurs, such graduation defining the angular position of said pump shaft at the start of dynamic injection for said delivery connection.

* * * * *